US009010248B1

(12) United States Patent
Manole et al.

(10) Patent No.: US 9,010,248 B1
(45) Date of Patent: Apr. 21, 2015

(54) 40 MM GUN SLEEVE CARTRIDGE CASE FOR M320 GRENADE LAUNCHER AMMUNITION

(71) Applicants: Leon Manole, Great Meadows, NJ (US); Arthur Ricardo Pizza, Maywood, NJ (US); Ernest Lee Logsdon, Newton, NJ (US); Gary Anthony Pacella, Stroudsburg, PA (US); Anthony J. Sebasto, Budd Lake, NJ (US)

(72) Inventors: Leon Manole, Great Meadows, NJ (US); Arthur Ricardo Pizza, Maywood, NJ (US); Ernest Lee Logsdon, Newton, NJ (US); Gary Anthony Pacella, Stroudsburg, PA (US); Anthony J. Sebasto, Budd Lake, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/714,759

(22) Filed: Dec. 14, 2012

Related U.S. Application Data

(60) Provisional application No. 61/577,235, filed on Dec. 19, 2011.

(51) Int. Cl.
*F42B 5/02* (2006.01)

(52) U.S. Cl.
CPC ..... *F42B 5/02* (2013.01)

(58) Field of Classification Search
CPC ..... F42B 5/02
USPC ..... 102/368, 430, 437, 439, 443, 464, 469, 102/470, 473, 490, 501
See application file for complete search history.

(56) References Cited

U.S. PATENT DOCUMENTS

| | | | | |
|---|---|---|---|---|
| 3,738,271 | A * | 6/1973 | La Costa | 102/430 |
| 3,820,463 | A * | 6/1974 | Leonard et al. | 102/436 |
| 3,967,552 | A * | 7/1976 | Settles et al. | 102/430 |
| 5,936,189 | A * | 8/1999 | Lubbers | 102/439 |
| 8,887,641 | B1 * | 11/2014 | Manole et al. | 102/521 |

* cited by examiner

*Primary Examiner* — James S Bergin
(74) *Attorney, Agent, or Firm* — Michael C. Sachs

(57) ABSTRACT

A non-spinning 40 mm ammunition round for firing in an M320 grenade launcher. The round includes a cylindrical shaped gun sleeve cartridge case, which covers the standard rifling inside the M320, and thus presents a smooth bore surface to the fired ammunition. Because the ammunition is not launched in a spinning mode, it may now comprise those guidance and camera components as may be desired which components would not have been possible to employ on a round that is spinning.

7 Claims, 3 Drawing Sheets

40 MM GUN SLEEVE CARTRIDGE CASE FOR M320 GRENADE LAUNCHER AMMUNITION

CROSS-REFERENCE TO RELATED APPLICATIONS

The present application claims the benefit of priority of U.S. provisional patent application Ser. No. 61/577,235 filed on Dec. 19, 2011 which is incorporated by reference herein.

U.S. GOVERNMENT INTEREST

The inventions described herein may be made, used, or licensed by or for the U.S. Government for U.S. Government purposes.

BACKGROUND OF INVENTION

There exists a need to extend the range of existing 40 mm low velocity projectiles and also to eliminate projectile spinning, when fired from a M203 or M320 Gun. Further, there is a need extend projectile range from the current 400-450 meters up to as much as 1000 plus meters. In addition, a need exists to provide projectile guidance, navigation and control subsystem components within the body of the low velocity 40 mm projectile, to permit increased accuracy and precision hits on targets as far range as beyond 1000 meters. To accomplish these aims it is required to fire the guided projectiles in the M320 without projectile spinning. This is because the guidance, navigation and control subsystems would not function properly if the cartridge were spinning at any appreciable revolution rate.

The M203 is not a stand-alone gun. It must be attached to an M16 or M4 rifle, for instance, and fires a family of 40 mm low velocity projectile rounds. In order to load a 40 mm round into an M203, the forward sleeve of the gun tube is slid forward, and a 40 mm round is pushed into the sleeve. The sleeve is then slid backwards and locked into position, ready to fire. The barrel of the M203 is rifled, which spins up the projectile as it travels down the barrel tube, and the projectile leaves the gun tube with a high spin rate. Therefore, to be able to add the proposed guidance, navigation and control subsystems in a projectile for the M203/M320, a way is needed to avoid projectile spin. Projectiles currently used for the M203/M320 include the M433 High Explosive Dual Purpose Round, M406 High Explosive Round, M583A1 Star Parachute Round, M585 White Star Cluster Round, M713 Ground Marker Round, M781 Practice Round, M651 CS Round and M576 Buckshot Round.

The 40 mm cartridge case is typically not reused or recycled after firing. If the cartridge case gets stuck in the gun tube, there is a tool to help the war-fighter push it from the tube. The M320 fires the same 40 mm low velocity ammunition as the M203. There are several improvements that the M320 has compared to the M203. The M320 has stand alone single shot capability and may be fired by the war-fighter without attaching to a gun. It also has the capability to be attached to and fired from the M16/M4 rifle, similarly to the M203. A major improvement of the M320 is the ability of the firing tube to open sideways. By opening sideways, longer ammunition can be loaded into the M320 gun tube as compared to loading in an M203. While the approximate maximum length of the projectile is approximately five inches in the M203, projectiles several inches longer can be loaded into an M320. Both M203 and M320 have rifled barrels which induce spinning in the projectile as it travels through the gun tube. The spin increases accuracy of the round while in flight, and the spin rate is substantial at approximately 1800 revolutions per second. While this spin is good for standard 40 mm ammunition, it is however not applicable for the latest in 40 mm guided munitions, as was mentioned. Guided ammunition would need to have no spin (or very little spin) so that the seeker or camera therein can see the target clearly while in flight. If the projectile were to spin the seeker or camera would therefore not be able to find the target. There are several devices that can be added to solve this problem, but they are expensive and take up payload space inside the projectile which is better needed to carry explosives, e.g., needed in the projectile. There are also decoupling bands that may be placed on the projectile to reduce or eliminate spin. Such bands are not always effective and a good percentage of the projectiles coming from the gun tube still have spin of varying revolutions per second. What is needed is a way to fire the guided projectiles in an M320, e.g., without the projectile spinning.

BRIEF SUMMARY OF INVENTION

Proposed herein is a gun sleeve cartridge case 10 (FIG. 1 and FIG. 2) for, e.g., a 40 mm M320 system projectile, in order to solve the spin problem as was mentioned in the M320. The 40 mm, M320 gun sleeve cartridge case 10 loads and fits into an M320, and can also be easily removed after firing. The sleeve portion (which will enclose the 40 mm Projectile) is made to slide snugly right into the M320 tube, and effectively shields against the rifling found in the barrel of the Gun launcher tube 15, whereas the interior 16 of the sleeve 10 can now be seen to be a perfectly smooth bore. Therefore when this projectile is fired it will not now be spun up by the rifling in the gun tube, but only see the smooth bore. The projectile flight will now not have any appreciable spin, which is the desired result to have been achieved. This 40 mm gun sleeve cartridge case ammunition can easily be inserted into an M320 gun, and sleeve 10 will take up the entire length of the gun tube.

OBJECTS OF THE INVENTION

Accordingly, it is an object of the present invention to provide means for an ammunition projectile to be launched (without spin on the launched projectile in flight) from a conventional M320 grenade launcher gun.

Another object of the present invention to provide means for launching a guided munition in an M320 grenade launcher gun.

It is a further object of the present invention to provide extended range for an ammunition projectile fired from an M320 grenade launcher gun through effectively providing a longer gun tube path during firing.

It is a yet another object of the present invention to provide extended range for an ammunition projectile fired from an M320 grenade launcher gun through effectively providing a thicker walled, reinforced strength gun tube which can withstand more propellant pressure applied during launching, to yield greater velocities hence increased range.

It is a still further object of the present invention to provide ammunition projectile fired from an M320 grenade launcher which due to de-spinning can eliminate costly and difficult to manufacture flutes from the explosive shape charge jet liner in the ammunition.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention. The invention for example could be used on grenade launchers other than an M320, including stand alone devices to receive a grenade launcher, other types of shoulder launched weapons, or weapons other than grenade launchers, and for ammunition other than necessarily the caliber or types shown here, where the principles of the invention might be beneficially employed.

LIST OF DRAWINGS

DETAILED DESCRIPTION

Presented herein is a way to fire guided projectiles in an M320 without the projectile spinning. A 40 mm M320 gun sleeve cartridge case 10 (FIGS. 1 and 2) has been designed to solve the spin problem in the M320. The 40 mm, M320 gun sleeve cartridge case 10 loads and fits snugly into an M320 and can be easily removed after firing. The sleeve slides into the M320 tube and goes against and covers over the tube's interior rifling. What will be experienced now by the projectile would only be the interior 16 of sleeve 10, which is smooth bore. The 40 mm M320 gun sleeve cartridge case 10 is easily inserted into an M320 gun and will take up the entire length of the gun tube. The sleeve material is aluminum, or steel, or a composite. The sleeve length might be 7 to 14 inches.

Figure 1:
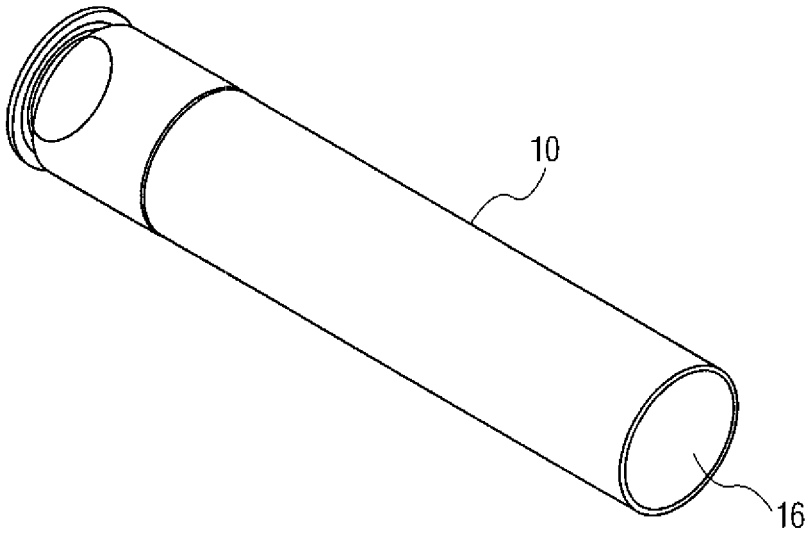
FIG. 1 shows a 40 mm gun sleeve cartridge case according to this invention.
Figure 2:
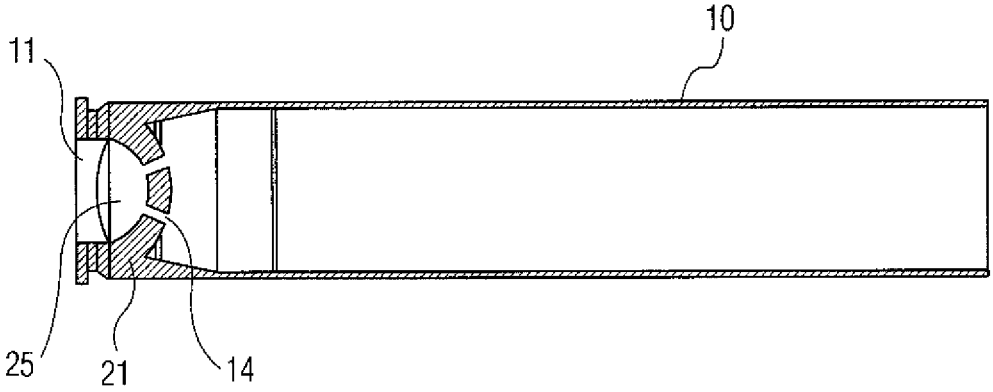
FIG. 2 shows a cross sectional view of a 40 mm gun sleeve cartridge case according to this invention.
Figure 3:
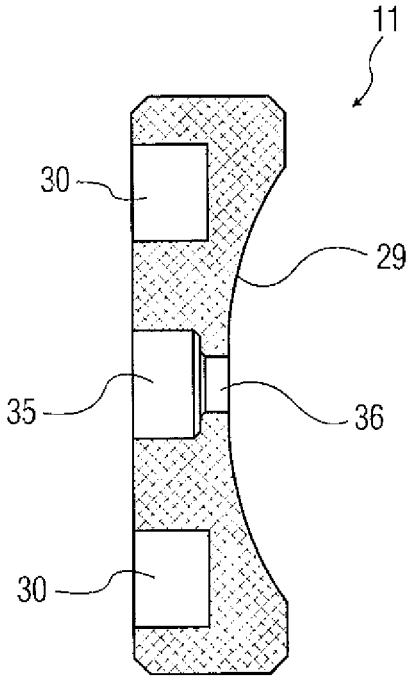
FIG. 3 shows a base plug for a 40 mm gun sleeve cartridge case according to this invention.
Figure 4:
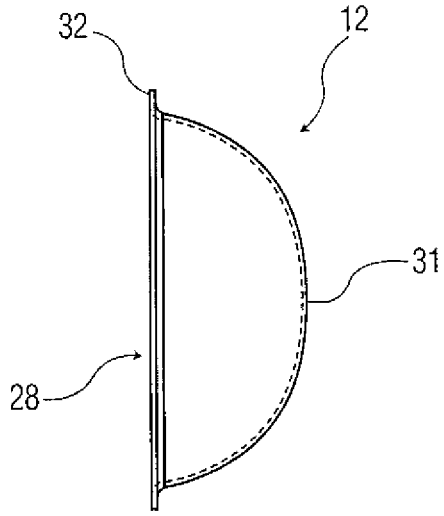
FIG. 4 shows a propellant closure cup for a 40 mm gun sleeve cartridge case according to this invention.
Figure 5:
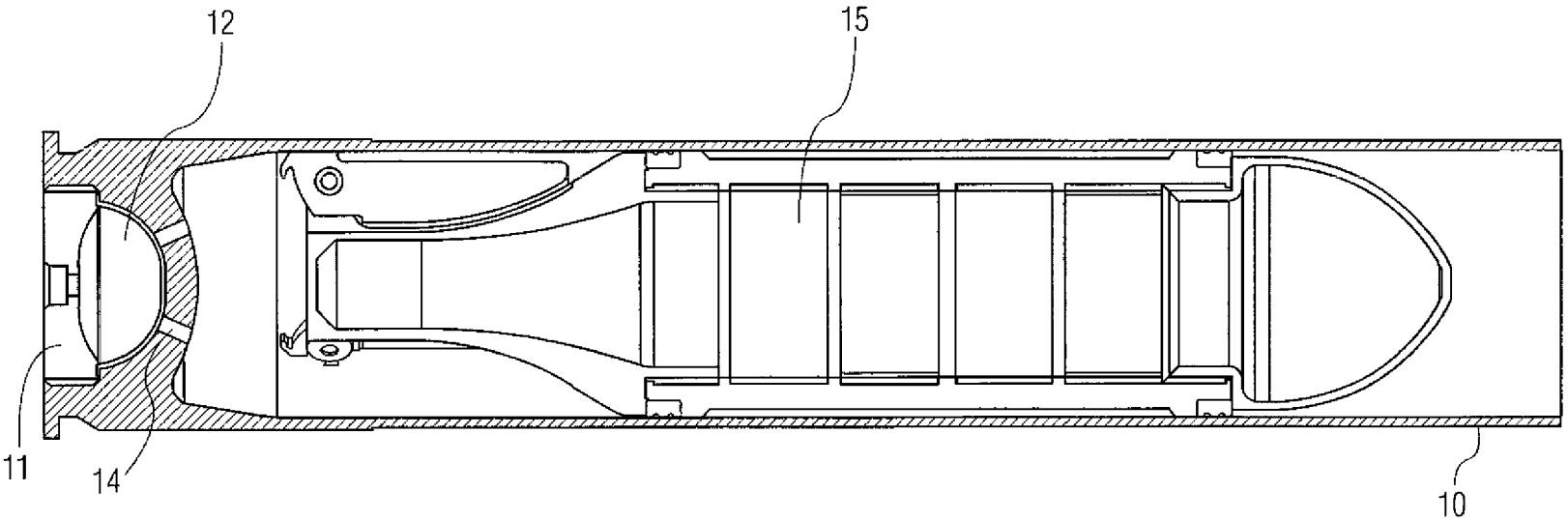
FIG. 5 shows a cross sectional view of a 40 mm projectile with gun sleeve cartridge case according to this invention.

FIG. 1 shows a model 40 mm M320 gun sleeve cartridge case 10. FIG. 2 is a cutaway drawing of the 40 mm M320 gun sleeve cartridge case 10. The sleeve 10 has a built in back panel portion 21 which has an indented area sized to receive cup 12 of FIG. 4, and also has vent holes 14. FIG. 3 is a cutaway drawing of the 40 mm M320 gun sleeve cartridge case base plug 11. The plug has a slightly rounded open area 29 (like a large dimple area), which will assist in the propellant burning patterns as opposed to a flat surface there. The plug has a hole 35 for firing pin means and a through hole 36 to assist in the ignition of propellant in the cup (FIG. 4). The plug also has dead ended openings 30 which can receive a tool means if one wanted to rotate the plug for threading it in the base of cartridge case 10. FIG. 4 shows a cutaway drawing of the 40 mm M320 gun sleeve cartridge case propellant closure cup 12. Cup 12 has a metal bowl part 31 which is open from the direction 28. Cup 12 has a lip part 32. Cup 12 is sized to fit right into open space 25 and the (copper or other material) cup bowl is filled with propellant then the base plug is screwed in over it, to hold the cup in place. FIG. 5 shows a cutaway drawing of a 40 mm M320 gun sleeve cartridge case 10 with projectile 15 ready for insertion into the M320 and ready to be fired. The loading of the M320 Gun Sleeve 10 is done as follows. Cartridge case propellant closure cup 12 is inserted into the M320 sleeve 10 while in an upright position. Propellant as needed is then loaded into closure cup 12. While still in an upright position cartridge case base plug 11 is either threaded or pressed into the rear of the M320 sleeve 10. The 40 mm projectile 15 is then pressed into the sleeve 10. This completes the loading of the M320 gun sleeve 10. Of course, loading procedures may be changed in accordance with different safety procedures of different loading plants. A round could even be field loaded by an experienced soldier if desired using these methods. The bowl 25 of the cartridge case has been designed to snugly fit propellant closure cup 12. Propellant closure cup 12 has been designed to allow for the maximum amount of propellant for maximum velocity of the 40 mm ammunition without exceeding the impulse requirement for the person shooting the gun and strength constraints of the gun. Closure cup 12 and case base plug 11 have the new design benefit of locking in the propellant so that it cannot get into the sleeve 10. Such provides a major improvement over existing cartridge case and closure cup and case base plug case design arrangements. Propellant closure cup 12 contains an overlapping lip that mates with case base plug 11 which prevents propellant from leaking through vent holes 14 into the M320 sleeve 10 (a possible number of vent holes could be six).

Upon firing of the propellant, the copper cup 12 will immediately melt away and the pressure of expanding gases caused by the burned propellant (approximately 4000 psi, e.g.) will be of sufficient pressure (approximately 300 psi, e.g.) needed to blow through vent holes 14 to propel the round out of the sleeve 10. Therefore, it will be seen that the M320 gun sleeve 10 effectively converts an M320 into use as a smooth bore tube. This result allows for newly designed (non spin type) 40 mm guided projectiles to be fired from an M320. In addition, the M320 gun sleeve 10 effectively fortifies the gun tube (with an inside sleeve added) so the M320 tube ends up much stronger and able to fire at higher pressures, and this can provide even higher velocities achievable for 40 mm fired projectiles. Higher velocities can therefore lead to longer ranges, a desirable result. Of further added benefit, the M320 gun sleeve 10 can be used again and again, and is also easily removed from the M320 gun after firing. In government testing, twenty M320 sleeves were reloaded and re-fired five or more times. All sleeves were easily removed from the M320 after firing. M320 sleeves 10 can be made longer than the M320 gun tube's length, to provide even higher velocities (due to a longer effective barrel during firing stage) for the same gun pressures. The M320 gun sleeve 10 has been seen to allow for extended range of 40 mm ammunition by more than 50%. Velocity has doubled out to 150 meters per second. Without this invention, projectiles that are designed for high rates of spin would have required expensive flutes on shape charge liners inside the projectile, in order to function properly. Since the M320 gun sleeve 10 allows a projectile 15 to exit without any spin at all there is no need for flutes to be placed on any shape charge liners. Moreover, flutes on shape charge liners are difficult to manufacture, as well as being expensive.

The many benefits of this invention include the following. The 40 mm M320 gun sleeve cartridge case 10 provides no spin to the projectile in a rifled gun tube. This allows for guided munitions to be fired from a rifled tube. The 40 mm M320 gun sleeve cartridge case 10 is easily removed from the M320 after firing and can be reused. The 40 mm M320 gun sleeve cartridge case 10 allows for higher pressures and therefore higher velocities for the 40 mm projectiles in the M320. The 40 mm M320 gun sleeve cartridge case 10 allows for a new generation of 40 mm ammunition to be designed with extended range, guidance with more accurate lethality. The 40 mm M320 gun sleeve cartridge case 10 can be longer than the M320 tube and therefore provide more efficient use of propellant load to provide higher velocity and extended range without increased pressures in the gun tube. The gun sleeve cartridge case 10 can be lengthened, hence to provide more velocity, hence to provide enhanced range, yet without appreciably increased recoil to the shooter when firing the launcher as might have been feared with a longer tube, because the impulse caused by the amount of burning propellant is not changed even though the length of the gun sleeve cartridge case 10 may have been increased. The 40 mm M320 gun sleeve cartridge case 10 is applicable to other rifled medium caliber and shoulder launched weapons and can be used to provide no spin for guided projectiles, higher velocity and extended range without increased pressures in the gun tube. The 40 mm M320 gun sleeve cartridge case 10 allows for 40 mm rounds to be launched without spin and therefore, the explosive shape charge jet liner does not require the use of costly and difficult to manufacture flutes on the shape charge liner as compared to rifled spinning projectiles with shape charge liners. The 40 mm M320 gun sleeve cartridge case 10 allows for extended range of 40 mm ammunition by 50% or greater. The closure cup 12 and case base plug 11 have a new design which locks the propellant in closure cup 12 and case base plug 11 so that it cannot get into the 40 mm M320 gun sleeve cartridge case 10 projectile 15 area before firing.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A 40 mm ammunition round for firing in an M320 grenade launcher, said round being launched without spinning of said round, the round comprising:

a high explosive 40 mm projectile, a hollow cylindrical shaped gun sleeve cartridge case further including an enclosed aft wall section, said aft wall section having a bowl area therein sized for receiving a propellant closure cup, said propellant closure cup positioned fore of a base plug threaded into the rear of said cartridge case, said closure cup fully loaded with propellant powder therein, and wherein said propellant closure cup further contains an overlapping lip that mates with said base plug to prevent propellant from leaking through any aft wall vent holes to inside the cartridge case's interior area, and wherein said projectile is inserted into said cartridge case in a direction with aft end of said projectile fore of said closure cup so that said projectile may be pressed into, and fully inserted into, said cartridge case.

2. The round of claim 1 wherein the cartridge case can be removed from the M320 after firing and can be reused.

3. The round of claim 1 wherein the absence of spin allows for use of projectile ammunition having guidance subsystems yielding more accurate lethality.

4. The round of claim 1 wherein the inclusion of a cartridge case over length to that of the M320 gun tube length enables projectile ammunition having extended range.

5. The round of claim 4 wherein range is extended by over 50%.

6. The round of claim 1 wherein the inclusion of a cartridge case allows for a stronger effective M320 gun tube allowing use of increased pressures therein which enables projectile ammunition to have extended range.

7. The round of claim 1 wherein the 40 mm M320 gun sleeve cartridge case allows for 40 mm rounds to be launched without spin and therefore, the ammunition does not require the use of costly and difficult to manufacture flutes on the shape charge liner as compared to rifled spinning projectiles with shape charge liners.

* * * * *